United States Patent [19]

Hill

[11] Patent Number: 4,877,087

[45] Date of Patent: Oct. 31, 1989

[54] SEGMENTED FIN HEAT EXCHANGER CORE

[75] Inventor: David T. Hill, Granger, Ind.

[73] Assignee: Sundstrand Heat Transfer, Inc., Dowagiac, Mich.

[21] Appl. No.: 641,476

[22] Filed: Aug. 16, 1984

[51] Int. Cl.[4] ..... F28F 1/20

[52] U.S. Cl. ..... 165/181; 165/184

[58] Field of Search ..... 165/146, 181, 184

[56] References Cited

U.S. PATENT DOCUMENTS

| | | | |
|---|---|---|---|
| 3,345,829 | 10/1967 | Hall | 165/146 X |
| 3,362,058 | 1/1968 | Morris et al. | 165/184 X |
| 3,476,180 | 11/1969 | Straight Jr. et al. | 165/181 X |
| 3,578,952 | 5/1971 | Boose | 165/184 X |
| 4,416,223 | 11/1983 | Hashizume | 165/146 X |

OTHER PUBLICATIONS

Kenichi Hasizume, "Heat Transfer and Pressure Drop Characteristics of Finned Tubes in Cross Flow", Dec. 1981, pp. 15–20, Heat Transfer Engineering vol. 3 #2.

*Primary Examiner*—Ira S. Lazarus
*Assistant Examiner*—Peggy Neils
*Attorney, Agent, or Firm*—James A. Wanner; Trevor B. Joike; Harold A. Williamson

[57] ABSTRACT

A core for use in a heat exchanger including a tube of heat conductive material and a tape of heat conductive material wrapped around the tube. The tape has a base extending completely about the periphery of the tube in abutment therewith and a plurality of spines extending generally radially from the base in fanned relation over an arc length in the range of about 180°–220°. The tube is essentially free of the spines along a longitudinally extending area having an arc length in the range of approximately 180°–140°.

11 Claims, 2 Drawing Sheets

SEGMENTED FIN HEAT EXCHANGER CORE

FIELD OF THE INVENTION

This invention relates to heat exchanger cores, and more specifically, to heat exchanger cores of the type utilizing tubes provided with segmented external fins.

BACKGROUND OF THE INVENTION

Prior art of possible relevance includes U.S. Pat. No. 2,317,519 issued Apr. 27, 1943 to Coons and U.S. Pat. No. 3,495,657 issued Feb. 17, 1970 to Keith. Also of possible relevance is an article entitled "Heat Transfer and Pressure Drop Characteristics of Fin Tubes in Cross Flow" by Kenichi Hashizume published in *Heat Transfer Engineering* Vol. 3, No. 2, October-December, 1981, pages 15–20, inclusive and Japanese patent application laid open No. 57-105689.

Many heat exchangers employ cores constructed of one or more tubes through which a heat exchange fluid may flow and which are provided with external, generally radially extending, fins. Such cores may be divided into two general groups, namely, smooth finned and segmented fin.

In the case of smooth finned cores, plate-like elements are secured by any of a variety of means to the tubes. In the segmented fin type, a radially outwardly extending fin is cut at closely spaced intervals to provide radially outwardly extending spines.

Generally speaking, the segmented fin constructions have better heat exchange performance than otherwise identical smooth finned constructions. This is due to the fact that the spines constituting the segmented fin increase the turbulence of the fluid passing therethrough thereby decreasing the thickness of the boundary layer and providing an increased rate of heat transfer.

At the same time, because of the increased turbulence, a greater pressure drop will be experienced across a segmented fin core than across an otherwise identical smooth finned core due to increase resistance to fluid flow caused by the presence of the spines constituting the segmented fin.

Where the fluid is propelled by a fan or the like, the higher pressure drop requires the use of a larger motor for driving the fan with the accompanying increase in energy requirements. In the usual case, the tubes carry a heat transfer medium subject to heating or cooling by the flow of a fluid, most typically air, across the fins and the tubes. The pressure drop, and thus the energy requirement to pass a fluid through the fins is related to what might be termed "spine density", that is, the number of spines in a given volume through which the fluid must pass.

At the same time, the overall heat transfer coefficient of such structures is largely controlled by the air or fluid side heat transfer coefficient and the effectively air side area over which heat transfer may occur.

When air or fluid flows across a row or rows of tubes having conventional fins, recirculation zones are formed in the downstream side of the tubes. These recirculation zones are areas of relatively low localized air velocity with the consequence that the air side heat transfer coefficient in such areas are relatively low and the finned heat transfer area in such zone is not utilized effectively.

Similarly, it has been found that localized areas of low air velocity may exist near the roots of conventional fins on the upstream side of the tube. And, of course, where fins are segmented, there is an increase to the resistance to air flow as mentioned previously. This may increase the size of the recirculation zone downstream of the tube as well as decrease the local air velocity both upstream and downstream of the tube which reduce the effectiveness of the fin in such areas. Consequently, there is underutilization of the fin material in one or the other of such areas. Such underutilized material not only adds to the cost of manufacture of the core, but increases the size of the same as well as the air side pressure drop.

The present invention is directed to overcoming one or more of the above problems.

SUMMARY OF THE INVENTION

It is a principal object of the invention to achieve a high degree of utilization of fin material in a segmented external fin heat exchanger. It is also an object of the invention to provide a segmented, externally finned heat exchanger core with reduced resistance to air flow to thereby minimize the energy required to pass the heat exchange fluid through the fins.

An exemplary embodiment of the invention achieves the foregoing objects in a core construction for a heat exchanger including a tube of heat conductive material. A tape of heat conductive material is wound about the tube, the tape having a base extending completely about the periphery of the tube and in abutment therewith to be in heat transfer relation with the tube. A plurality of spines extend generally radially from the base in fanned relation over an arc length in the range of about 180°–220° in circumferential rows. The circumferential rows are aligned generally longitudinally of the tube along the length thereof and the tube is essentially free of the spines along a generally longitudinally extending area having an arc length in the range of approximately 180°–140° . In a highly preferred embodiment, the longitudinal row of spines defined by the circumferential rows and the longitudinally extending area are both parallel to the axis of the tube.

In a highly preferred embodiment, the axial row of spines resulting from the alignment of the circumferential rows may face either upstream or downstream of the direction of fluid flow across the tube. In the case of upstream facing spines, there is an absence of material in the recirculation zones downstream of the tube while where the spines extend from the downstream side of the tube, areas of low velocity near the roots of the spines in prior art constructions on the upstream side of the tube are avoided. In either case, the material absent from such areas presents a material savings thereby lowering the cost of the construction as well as minimizing its size. Furthermore, to the extent that such spines that are eliminated increase the resistance to fluid flow across the tube, the pressure drop is likewise reduced.

In a highly preferred embodiment, the arc length of both the circumferential rows of the spines and the area free from spines is approximately 180° to maximize manufacturing savings.

In the usual case, the tape will be spirally wrapped about the tube and the area free from spines is provided by a series of spaced reliefs in the tape that extend transversely from one edge of the tape to the base. The sum of the length along the length of the tape of each series of spines between two adjacent reliefs and the length of each relief is approximately equal to the peripheral length of the tube.

Other objects and advantages will become apparent from the following specification taken in connection with the accompanying drawings.

DESCRIPTION OF THE PREFERRED EMBODIMENT

Figure 1:
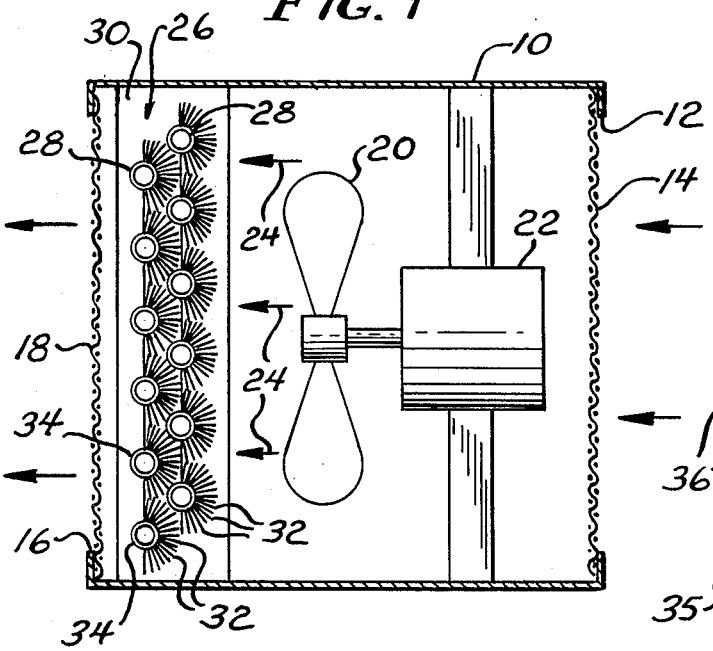
FIG. 1 is a somewhat schematic, partial sectional view of a heat exchanger embodying a core made according to the invention.

An exemplary embodiment of a heat exchanger core made according to the invention is illustrated in a typical environment in which it may be used in FIG. 1. Therein there is seen a housing 10 having an open inlet 12 closed by wire mesh 14 or the like and a similar outlet 16 spaced from the inlet 12 and also partially closed by mesh 18. The housing 10 thus defines a flow path between the inlet 12 and the outlet 16 and may contain a rotary fan 20 driven by a motor 22 for driving air in the direction of arrows 24 along the flow path.

On the outlet side of the housing 10, and downstream from the fan 20, is a heat exchanger core, generally designated 26, made according to the invention. The core 26 illustrated in FIG. 1 is a multiple tube core having plural tubes 28, formed of heat conductive material, in plural rows although a single row could be employed if desired. As shown in FIG. 1, the tubes 28 in each row are on staggered centers with respect to the tubes in the adjacent row but the tubes in each row could be aligned if desired.

The tubes 28 are adapted to carry a heat exchange medium that is to be subjected to a heat exchange operation within the heat exchanger 10 which could be either heating or cooling of the fluid contained in the tubes 28. The tubes 28 are mounted in the heat exchanger at right angles to the flow path therein by any suitable means such as a plate 30. Other angular configurations could be employed if desired.

Each of the tubes 28 is externally finned with segmented fins and carries spines 32 formed of a heat conductive material. The spines 32 on each tube 28 fan radially outwardly in a single group. As illustrated in FIG. 1, the spines 32 are located on the upstream sides of the tubes 28 and a downstream side 34 of each tube is spine free. However, as will be seen, the spines 32 could be located on the downstream side of the tubes 28 with the spine free area 34 being provided on the upstream side In other words, the mounting plate 30 for the heat exchanger core 26 could be rotated 180° from the position illustrated in FIG. 1.

Figure 2:
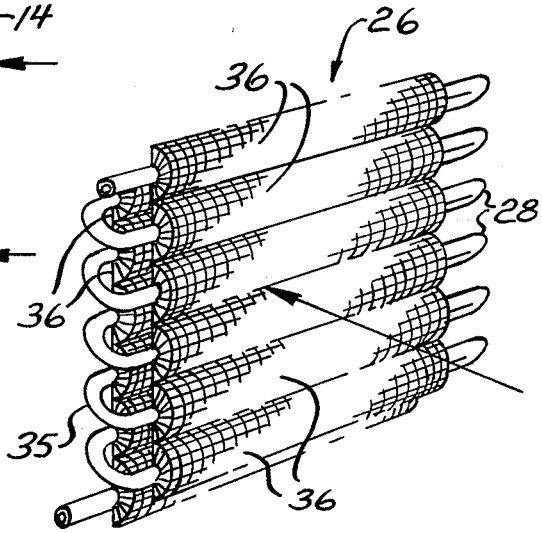
FIG. 2 is a perspective view of multiple tube core made according to the invention.

Turning now to FIG. 2, the core 26 is shown in perspective and it will be seen that the tubes 28 are in fact defined by a single, elongated tube 35 wound generally in a serpentine fashion to provide two rows of the tubes 28 with the tubes 28 in one row being staggered with respect to the tubes in the other. The configuration is known in the art. Each run of the tube 35 carries a longitudinally extending row 36 of the spines 32 along its length. Preferably, each row 36 is not only longitudinally extending with respect to the tube runs 28, but is parallel to the axis of each such tube run 28. Though not shown, the spines 32 may also be located on the bends of the tube 35 interconnecting adjacent rims.

Oppositely of each row 36 of the spines 32, the tubes 28 have the longitudinally extending spine free areas 34. Again, it is preferably that the spine free areas 34 not only be longitudinally extending with respect to the tubes, but be parallel to the axis thereof.

Figure 3:
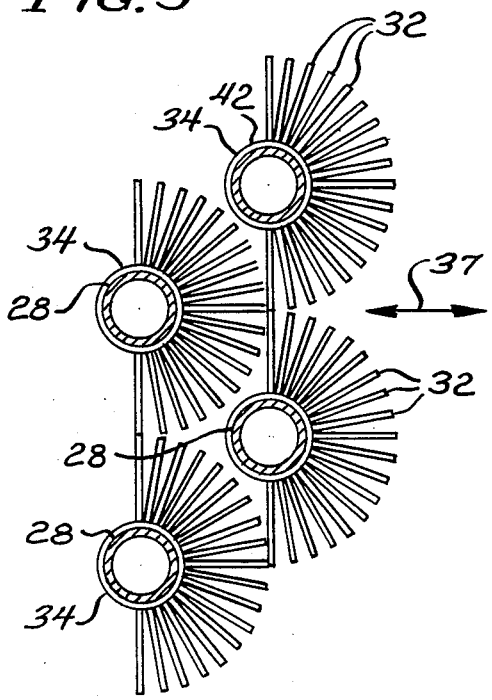
FIG. 3 is a sectional view of a core made according to the invention.

As mentioned previously, the spines 32 may either face toward or away from the direction of air flow as indicated by a two-headed arrow 37 shown in FIG. 3.

Also, as seen in FIG. 3, the spines 32 extend about an arc length of approximately 180° and the spine free area 34 has an identical arc length of approximately 180°. However, according to the invention, the arc length of the tube provided with the spines 32 may range from about 180° to approximately 220°. Accordingly, the arc length of the area 34 free of spines will be in the range of approximately 180° to approximately 140°. As will be seen, approximately identical arc lengths of 180° for both the spines 32 and the spine free areas 34 are preferred for manufacturing reasons.

When the spines 32 face upstream or in the direction of air flow 37, the recirculation zones that may occur on the downstream side of the tubes will be in the spine free areas 34. Thus, no heat transfer material used for forming the spines 32 is located in the areas where such recirculation zones occur and where heat transfer efficiency is low. Thus, material savings is provided.

Conversely, when the spines 32 are located downstream in the direction of flow, no heat transfer material in the form of spines 32 is located in the upstream areas near the center of the tube whereat there would be low velocity near the roots of the fins and low heat transfer efficiency. Again, material is saved.

In either case, the heat transfer per unit of weight of fin material is increased 85–95% over that found in prior art structures having spines extending about the entirety of the periphery of the tube for a full 360° of arc length. Test results tend to indicate that having the spine free areas 34 upstream provides a slight improvement in efficiency over having such spine free areas 34 located downstream in the path of air flow. The results, however, are so close that one arrangement cannot be said to be substantially preferred over the other.

Figure 4:
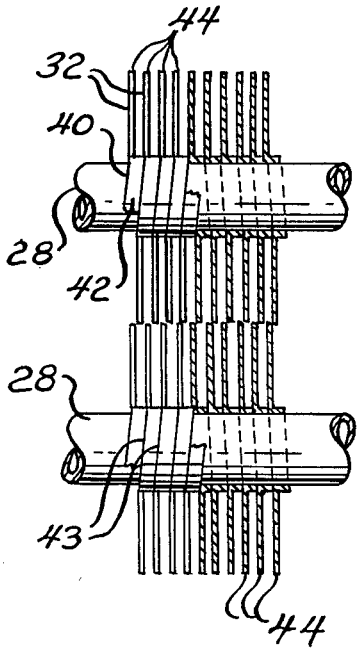
FIG. 4 is a fragmentary view along the flow path of a core made according to the invention.

As seen in FIGS. 3 and 4, the spines 32 are formed in fanned relation on the tubes 28 by helically wrapping a heat conductive tape 40 about the tubes 28. The tape 40 has a base portion 42 which is wrapped about the tubes 28 with adjacent convolutions being in substantial abutment as seen in FIG. 4 and the spines 32 are bent approximately 90° from the base 42 to extend substantially radially of the tubes 28. In the spine free areas 34, the tape is provided with reliefs 43 extending to the base 42 creating an absence of the spines 32.

When considered in terms of the spines 32 and the spine free areas 34, there results a plurality of side by side, circumferential rows 44 of the spines 32 as best seen in FIG. 4. Each of these rows 44 is aligned longitudinally along the length of the tube 28 to provide the longitudinally extending rows 36 of spines 32 as mentioned previously.

Figure 5:
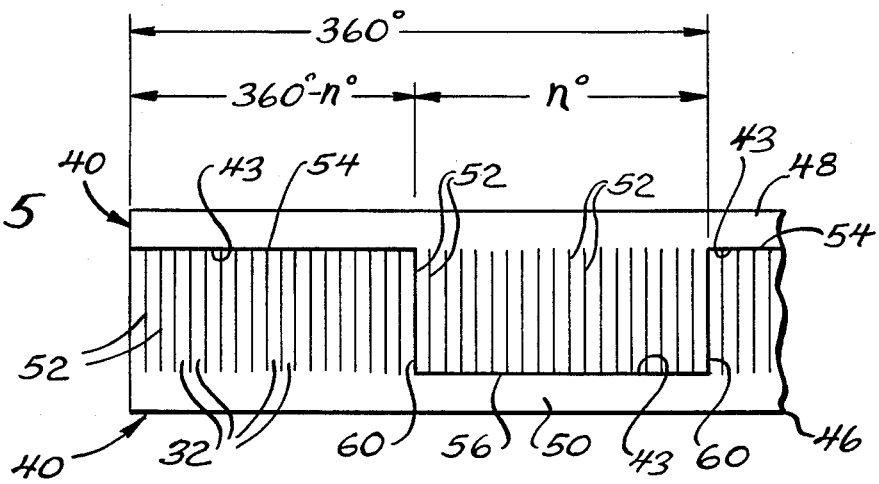
FIG. 5 is a plan view of a partially formed tape used for forming the spine utilized in the present invention.

One preferred method of providing the tubes with the alternating circumferential rows 44 of spines and spine free areas 34 will be described in connection with FIGS. 4 and 5. Referring to FIG. 5, there is provided a thin elongated sheet 46 of aluminum or the like which is cut to form the previously mentioned tape 40. On opposite longitudinal edges, there are functionally continuous zones 48 and 50. Each of the zones 48 and 50 will ultimately define the base 42 wound about the tubes 28 as seen in FIG. 4.

Between the zones 48 and 50 are transverse slits 52. Adjacent slits 52 define one of the spines 32.

The sheet 46 is further provided with alternating, longitudinally extending slits 54 and 56. The slits 54 are located just inwardly of the functionally continuous portion 48 while the slits 56 are located just inwardly of the functionally continuous portion 50 and define the reliefs 43 which ultimately provide the spine free areas 34. The slits 54 intersect the adjacent ends of the slits 52 as do the slits 56. The total length of one of the slits 54 and one of the slits 56 is equal to an arc length of approximately 360° about the tube 28. The length of the slits 54 relative to one of the slits 56 may be varied to provide arc lengths of the spine free areas 34 and spines 32 within the ranges mentioned previously. Thus, the slits 56 have an arc length of n° while the slits 54 have an arc length of 360°−n°. In the preferred embodiment, the same will be equal, that is, have an arc length of 180°.

It should be noted that the 360° arc length mentioned previously is approximate. Because the tape 40 is spirally wrapped, if the tape 40 is not stretched during wrapping the length of each complete convolution must be slightly greater than the circumference of the tube 28 to achieve axial alignment of the circumferential rows 44 of spines. Conversely, if the tape 40 is stetched during wrapping, a lesser tape length may be sufficiently increased by the stretching to achieve the desired alignment.

Finally, it should be observed that adjacent ends of the slits 54 and 56 will intersect a common one of the slits 52 shown at 60 in FIG. 5. As a consequence of this construction, the sheet 46 may be separated into two pieces, each of which may serve as a tape 40 for wrapping around one of the tubes 28. Where the slits 54 and 56 are of equal length, the resulting tapes 40 will be identical and there will be no waste requiring recycling or disposal since both tapes can be utilized to form heat exchanger cores having spined rows and spine free areas within the ranges mentioned previously.

In some instances where the slits 54 and 56 are of unequal length, both tapes may nonetheless be used. For example, if n is chosen to equal 140°, the two tapes formed from the sheet 46 will provide spined areas of 220° and 140°. The first or 220° tape could be used in a heat exchanger serving as an evaporator while the second or 140° tape could be used in forming a heat exchanger to serve as a condenser where the circumferential extent of the spines 32 has a lesser effect on heat exchange.

Figure 6:
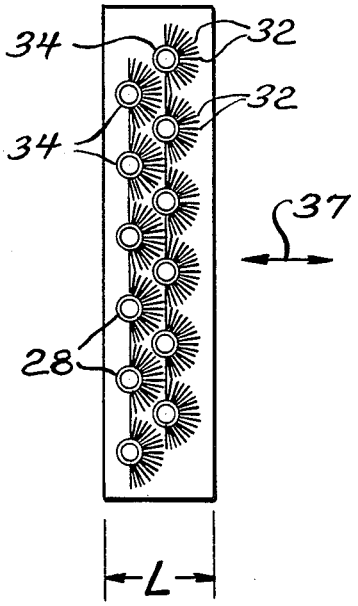
FIG. 6 is a somewhat schematic view of a multiple tube row core made according to the invention.

FIG. 6 illustrates a two row, multiple tube core made according to the invention and provided with staggered tubes. Because one side of the tubes 28 are spine free in the areas 34, the rows of the tubes 28 may be relatively closely spaced along the direction of air flow without causing interference between the spines 32. Thus, an overall length of the core and the direction of air flow 24 is shown at "L" and is relatively narrow.

Figure 7:
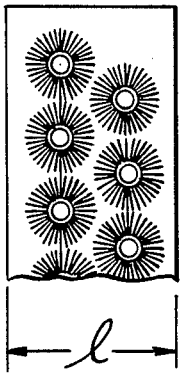
FIG. 7 (PRIOR ART)
FIG. 7 is a view similar to FIG. 6 but illustrating a prior art device.

In contrast, in a prior art construction such as is illustrated in FIG. 7, because the spines extend 360° about each of the tubes therein employed, to achieve assembly without interference between the spines, a considerably greater length "1" along the direction of air flow results.

It will therefore be appreciated that a core made according to the invention has several advantages. First, there is a reduction approaching 50% in the amount of material that must be utilized in forming the spines 42. This reduction in material is achieved with very little sacrifice of heat transfer capability since the missing material is located either at the front or at the rear surfaces of the tubes in the direction of air flow whereat heat transfer efficiency is low.

It will also be appreciated from a comparison of FIGS. 6 and 7 that a more compact core arrangement results. Thus, a space savings made be achieved in a heat exchanger in which the core is employed, even where a single row of the tubes 28 is utilized in the exchanger.

Furthermore, the elimination of spines from each of the tubes according to the invention achieves a reduction in the so-called air side pressure drop. Consequently, lesser energy is required to drive a fan such as the fan 20, to in turn move air through the core assembly.

What is claimed is :

1. A core for use in a heat exchanger comprising:

a tube of heat conductive material; and a tape of heat conductive material wound a round said tube, said tape having a base extending completely about the periphery of the tube in abutment therewith to be in heat transfer relation with the tube and a plurality of spines extending generally radially from said base in fanned relation over an arc length in the range of about 180°–220° in circumferential rows; the circumferential rows being aligned longitudinally of the tube along the length thereof such that said circumferential rows define an axial row of spines;

said tube being essentially free of said spines along a longitudinally extending area having an arc length in the range of approximately 180°–140 to thereby provide a heat exchanger having a heat transfer rate substantially equal to a heat exchanger having the spines extending over an arc length of 360°.

2. A heat exchanger including a core according to claim 1 and further including means for moving a heat exchanger fluid along a predetermined path, the centers of said arc lengths being nominally centered on said path.

3. The heat exchanger of claim 2 wherein said longitudinally extending area faces upstream in said path.

4. The heat exchanger of claim 2 wherein said longitudinally extending area faces downstream in said path.

5. The core of claim 1 wherein each said arc length is approximately 180°.

6. The core of claim 1 wherein each of said spines is formed by transverse slits in said tape extending from one edge of said tape to said base.

7. The core of claim 1 wherein said longitudinally extending area free of spines is provided by a series of spaced reliefs in said tape extending transversely from one edge of said tape to said base.

8. The core of claim 1 wherein each of said spines is formed by transverse slits in said tape extending from one edge of said tape to said base and said longitudinally extending area free of spines is provided by a series of spaced reliefs in said tape extending transversely from said one edge of said tape of said base, and wherein the sum of the length of said base along each series of spines between two adjacent reliefs and the length of said base along each relief is approximately equal to the periphery of said tube.

9. A core for use in a heat exchanger comprising:

a tube of heat conductive material; and a tape of heat conductive material wound a round said tube, said tape having a base extending completely about the periphery of the tube in abutment therewith to be in heat transfer relation with the tube and a plurality of spines extending generally radially from said base in fanned relation over an arc length of about 180° in circumferential rows; the circumferential rows being aligned longitudinally of the tube along the length thereof such that said circumferential rows define an axial row of spines;

said tube being essentially free of said spines along a longitudinally extending area having an arc length in the range of approximately 180°, said longitudinally extending area being defined by a series of aligned reliefs in said tape extending generally radially outwardly of said base to thereby provide a heat exchanger having a heat transfer rate substantially equal to a heat exchanger having the spines extending over an arc length of 360°.

10. A core for use in a heat exchanger comprising:

an elongated tube of heat conductive material; and a tape of heat conductive material helically wound around said tube, said tape having a base wrapped completely about the periphery of the tube in abutment therewith to be in heat transfer relation with the tube and a plurality of spines extending generally radially from said base in fanned relation over an arc length in the range of about 180°–220° in circumferential rows; the circumferential rows being aligned generally longitudinally of the tube along the length thereof;

said tube being essentially free of said spines along a generally longitudinally extending area having an arc length in the range of approximately 180°–140° to thereby provide a heat exchanger having a heat transfer rate substantially equal to a heat exchanger having the spines extending over an arc length of 360°.

11. The core of claim 10 wherein the longitudinally extending area and the longitudinal alignment of the circumferential rows are in a direction parallel to elongated axis of said tube.

* * * * *